US005101100A

United States Patent [19]

Kinoshita et al.

[11] Patent Number: 5,101,100

[45] Date of Patent: Mar. 31, 1992

[54] STREAK CAMERA OPERABLE WITH LOW DEFLECTION VOLTAGE

[75] Inventors: Katsuyuki Kinoshita; Motohiro Suyama, both of Hamamatsu, Japan

[73] Assignee: Hamamatsu Photonics K.K., Shizuoka, Japan

[21] Appl. No.: 620,875

[22] Filed: Dec. 3, 1990

[30] Foreign Application Priority Data

Dec. 1, 1989 [JP] Japan ..... 1-312508

[51] Int. Cl.[5] ..... H01J 40/14

[52] U.S. Cl. ..... 250/213 VT; 313/529

[58] Field of Search ..... 250/213 VT, 214 RC, 250/213 R; 313/527, 529, 422

[56] References Cited

U.S. PATENT DOCUMENTS

| | | | |
|---|---|---|---|
| 4,243,878 | 1/1981 | Kalibjian | 313/529 |
| 4,350,919 | 9/1982 | Johnson et al. . | |
| 4,942,293 | 7/1990 | Koishi et al. | 313/529 |
| 5,045,761 | 9/1991 | Takahashi | 250/213 VT |

FOREIGN PATENT DOCUMENTS

| | | |
|---|---|---|
| 2239554 | 9/1990 | Japan . |
| 2116359 | 9/1983 | United Kingdom . |

OTHER PUBLICATIONS

"A Specially Designed Femtosecond Streak Image Tube with Temporal Resolution of 50fs", H. Niu et al., General Physics Institute, USSR (no date) (no paging).

"Magnetic Focus Streak-Tube", Electro-Optical Products Division ITT (Jul. 1976).

"Theoretical and Experimental Study of Femtosecond Streak Image Tube", H. Niu et al., Xian Institute of Optics and Precision Mechanics (no date & no paging).

*Primary Examiner*—David C. Nelms
*Assistant Examiner*—Que T. Le
*Attorney, Agent, or Firm*—Sughrue, Mion, Zinn, Macpeak & Seas

[57] ABSTRACT

A streak camera for detecting a light signal representing optical events occurring in ultra-short time intervals, comprising a photocathode, an accelerating electrode, a focusing electrode, an anode, a traveling wave deflector having a deflecting electrode for deflecting photoelectrons emitted from the photocathode with a deflection voltage having a phase velocity, a deflection circuit for controlling the deflection voltage to be applied to the deflecting electrode of the deflector, an electron stream detector having for detecting the electron stream deflected by said deflector, and a voltage control unit for controlling voltages to be applied to the photocathode, the accelerating electrode, the focusing electrode, the anode and the electron stream detector, thereby controlling a potential distribution in a photoelectron transit path. The voltage control unit carrys out a voltage supply operation such that the anode is supplied with a positive voltage below 5 KV with respect to a voltage to be applied to the photocathode, and the focusing electrode is kept at the highest positive potential among the photocathode, the accelerating electrode, the focusing electrode and the anode.

11 Claims, 4 Drawing Sheets

STREAK CAMERA OPERABLE WITH LOW DEFLECTION VOLTAGE

BACKGROUND OF THE INVENTION

This invention relates to a streak camera for detecting optical events occurring in ultra-short time intervals.

A streak camera has been conventionally known to detect a high-speedy optical event. In this streak camera, an optical event occurring for an ultra-short time, for example several hundreds femtoseconds, is once converted into an electron stream which is deflected in a desired direction and then the electron stream is converted to a streak image on an output screen, thereby performing a time-to-space conversion operation of the optical event. The streak camera mainly includes a streak tube comprising a photocathode for converting an incident light signal into an electron stream, a front-side acceleration means such as an acceleration electrode for accelerating the electron stream, a focusing electrode for focusing the electron stream, an anode for attracting the electron stream emitted from the photocathode, an electron deflector comprising a deflection electrode for deflecting the focused electron stream in a predetermined direction, and an electron stream detector having a phosphor screen for detecting the deflected electron stream and displaying it as a streak image thereon, these elements being arranged in this order and accommodated in a vacuum envelope, and a voltage supply unit for supplying voltages to the above elements.

As one of the conventional streak cameras, there is known a streak camera in which the anode is kept at a potential equal or lower than that of the acceleration electrode, the focusing electrode is kept at the most highly positive potential in a photocathode to-anode region, and a traveling wave deflector is used as the deflector. This type of streak camera is described in detail in "THEORETICAL AND EXPERIMENTAL STUDY OF FEMTOSECOND STREAK IMAGE TUBE" of ELECTRO-OPTICAL PRODUCTS DIVISION by H. Niu, et al. In this type of streak camera, the anode is kept at a highly-positive potential (for example, +10 KV) with respect to the photocathode in order to improve time resolution (for example, to obtain a time resolution of less than 100 femtoseconds). Accordingly, when a streak tube having an ordinary tube length is used in the streak camera, a deflection sensitivity of the streak camera using the streak tube is lowered and thus the deflection electrode of the deflector is required to be supplied with a high deflection voltage (for example, several KV voltages). This requirement causes the deflection circuit to be complicated in construction.

Further, in this type of streak camera, if a voltage difference between the photocathode and the anode is set to be a small value in order to improve the deflection sensitivity of the streak camera, an impinging electron energy of photoelectrons (defined as a kinetic energy of the photoelectrons which just impinge on the phosphor screen) is lowered and thus an signal to-noise (S/N) ratio is also lowered. Such a streak camera having a lowered S/N ratio can not be practically used.

On the other hand, there is also known another type of streak camera in which a voltage difference between the photocathode and the anode is intentionally set to a small value (for example, about 2 KV), and a rear-side acceleration means such as a mesh electrode is provided behind the deflecting electrode to increase an impinging electron energy of the photoelectrons after deflected through the deflector. However, since this type of streak camera utilizes an magnetic field to focus an electron stream emitted from the photocathode, that is, an magnetic field is used to form an electron convergent lens, the deflection sensitivity is reduced to a small value, for example, 75 mm/KV. Therefore, a high deflection voltage, for example, several kilovolts must be applied to the deflection electrode to increase the deflection sensitivity. This causes the deflection circuit to be complicated in construction like the streak camera as described above.

Generally, when a small voltage difference is provided between the photocathode and the anode to reduce a travel speed of the photoelectrons transmitted through the electron deflector, a deflection band of the deflector is equivalently lowered and thus a deflection voltage can not be applied to the deflection electrode at a high speed (high frequency). Accordingly, in order to perform a high-speed deflection operation, in other words, in order to supply the deflection electrode with a deflection voltage of high throughrate (V/s), a high amplitude s necessarily required for the deflection voltage.

SUMMARY OF THE INVENTION

An object of this invention is to provide a streak camera in which a deflection operation of the electron deflector is carried out with a low deflection voltage having low amplitude (a small peak to-peak value) while a voltage difference between the photocathode and the anode is set to a small value.

In order to attain the above object, a streak camera according to this invention comprises a photocathode for emitting photoelectrons as an electron stream upon incidence of the light signal thereto, a first accelerating electrode for accelerating the electron stream emitted from said photocathode, a focusing electrode comprising at least one electrode element for focusing the accelerated electron stream, an anode for electrostatically attracting the focused electron stream, a traveling wave deflector having a deflecting electrode for deflecting the electron stream transmitted through said anode with a deflection voltage having a phase velocity, a deflection circuit for controlling the deflection voltage to be applied to the deflecting electrode of the deflector, an electron stream detector for detecting the electron stream deflected by the deflector, and a voltage control unit for controlling voltages to be applied to the photocathode, the accelerating electrode, the focusing electrode, the anode and the electron stream detector, thereby controlling a potential distribution in a photoelectron transit path. The voltage control unit carrys out a voltage supply operation such that the anode is supplied with a positive voltage below 5 KV with respect to a voltage to be applied to the photocathode, and the electrode element of the focusing electrode is kept at the highest positive potential among the photocathode, the accelerating electrode, the focusing electrode and the anode.

The electron stream detector comprises a microchannel plate for multiplying tho photoelectrons deflected by the deflector or another accelerating electrode for accelerating the photoelectrons deflected by the deflector, and a phosphor screen for forming a streak image on the basis of the multiplied or accelerated photoelectrons.

DETAILED DESCRIPTION OF THE DRAWINGS

Preferred embodiments of this invention will be described hereunder with reference to the accompanying drawings.

Figure 1:
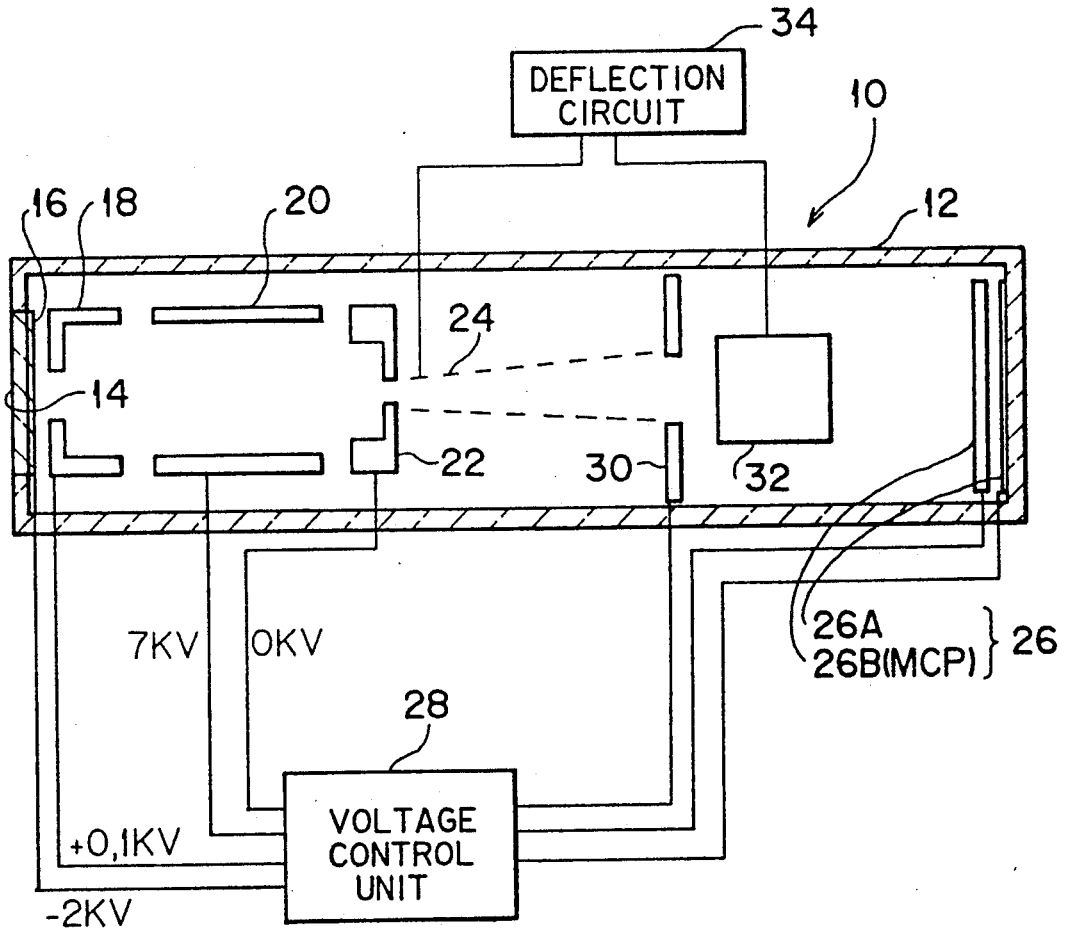
FIG. 1 shows a first embodiment of the streak camera according to this invention.

FIG. 1 shows a first embodiment of a streak camera according to this invention.

The streak camera 10 as shown in FIG. 1 includes a vacuum tight envelope 12 having at one end thereof a faceplate 14 for transmitting light therethrough, a photocathode 16 provided at the inner surface of the faceplate 14 for emitting photoelectrons as an electron stream in direct proportion to photon flux of the incident light, an accelerating electrode 18 for accelerating the electron steam emitted from the photocathode 16, a focusing electrode 20 comprising at least one electrode element for focusing the accelerated electron stream, an anode 22 for electrostatically attracting the focused electron stream, a traveling wave deflector 24 for deflecting the electron stream at a phase velocity, an electron stream detector 26 for detecting the electron stream defected by the deflector 24, a deflection circuit 34 for controlling a deflection voltage to be applied to the deflector 24 and a voltage control unit 28 for adjusting voltages to be applied to these elements. The above elements are arranged in this order in an axial direction of the envelope 12. The electron stream detector 26 comprises a phosphor screen 26A provided at the inner surface of the other end of the envelope 12 and a microchannel plate (hereinafter referred to as "MCP") 26B provided in front of the phosphor screen 26A with respect to an electron travel direction.

The streak camera 10 as shown in FIG. 1 further includes an isolation electrode 30 and a shift deflection electrode 32 arranged in this order between the traveling wave deflector 24 and the electron stream detector 26. The isolation electrode 30 serves to prevent an interference between a deflection voltage to be applied to the traveling wave deflector 24 and a shift deflection voltage to be applied to the shift deflection electrode 32, and the shift deflection electrode 32 serves to perform a positional correction of a streak image to be detected by the electron stream detector 26 and a retrace blanking of the streak image.

In the streak camera 10 thus constructed, the photocathode 16, the focusing electrode 20 and the anode electrode 22 constitutes an electron lens, and the voltage control unit 28 is designed so as to supply the photocathode 16, the accelerating electrode 18, the focusing electrode 20 and the anode 22 with −2 KV, 0.1 KV, 7 KV and 0 KV, respectively. Further, the deflection circuit 34 is designed so as to supply the traveling wave deflector 24 and the shift deflection electrode 32 with a deflection voltage of tens volts.

An operation of the streak camera 10 thus constructed will be described hereunder.

Upon incidence of a light signal having a time information through the faceplate 14 to the photocathode 16, photoelectrons are emitted as an electron stream from the photocathode 16. The emitted photoelectrons are accelerated by the accelerating electrode 18 and then focused by the electron lens system comprising the focusing electrode 20 and the anode electrode 22. Thereafter, the focused photoelectrons are deflected in a predetermined direction by the traveling wave deflector 24 and the shift deflection electrode 32, multiplied by the MCP 26B, and scanned on the phosphor screen 26B of the electron stream detector 26 to thereby convert a time change of the light signal into a spatial change thereof.

As described above, since the photocathode 16, the accelerating electrode 18, the focusing electrode 20 and the anode 22 of the streak camera of this embodiment are supplied with voltages of −2 KV, 0.1 KV, 7 KV and 0 KV, respectively, that is, the voltage difference between the photocathode 16 and the anode 22 is small, the photoelectrons are transmitted through the deflector 24 at a low travel speed (in other words, each of the photoelectrons transmitted through the deflector has a small kinetic energy (for example, 2 KeV), and thus the deflection sensitivity of the streak camera can be heightened. Further, the anode 22 is kept at a negative potential with respect to the accelerating electrode 18 (the anode 22 and the accelerating electrode 18 are supplied with 0 KV and 0.1 KV), and thus photoelectrons and secondary electrons which would be generated in the accelerating electrode 18 are prevented from reaching the electron stream detector 26, so that a high signal-to-noise ratio can be obtained. In this case, the streak camera 10 has a high time resolution, for example, approximately 1.5 ps.

Further, the traveling wave deflector 24 of this embodiment is designed such that the phase velocity thereof is substantially equal to the travel speed of the photoelectrons ($2.7\times10^7$ m/s for acceleration of 2 KV). Accordingly, a high deflection band above 1 GHz can be kept even though a deflection plate of the deflector 24 is lengthened, for example, by 60 mm. In this point, the deflection band of the conventional streak camera is limited to 150 MHz at maximum under the same condition. A meander type, a shielded spiral type, a spiral type or a lumped parameter type as disclosed in Japanese Unexamined Patent Application No. 2-239554 published on Sept. 21, 1990 may be used as the traveling wave deflector 24 as described above.

In this embodiment, the focusing electrode 20 is kept at a highly positive potential with respect to the photocathode 16 to allow the photoelectrons to transit through the focusing electrode 20 at high speed, so that dispersion in the transit time of the photoelectrons through the focusing electrode 20 can be reduced. As a result, a high time resolution of 1.5 ps can be obtained as described above. Further, since the traveling wave deflector 24 is used, the transit speed of the photoelectrons which are transmitted through the electron deflector 24 is substantially equal to the phase velocity of the deflection voltage on the deflecting electrode of the deflector 24, and thus the deflection band is not lowered even if the deflecting electrode is lengthened. Accordingly, it is possible to apply a deflecting voltage having a short rise-up time (a broad band-width) to the deflecting electrode even though the deflecting electrode is lengthened to improve the deflection sensitivity.

Generally, the streak tube of the streak camera is required to have a high scanning speed of the photoelectrons on the phosphor screen 26A of the electron stream detector 26, and thus the deflection voltage must be provided with a high throughrate (V/S). If an amplitude of the deflection voltage is lowered while the high throughrate is kept, the deflection voltage is necessarily provided with a waveform having a short rise-up time. As described above, since the streak camera 10 of this embodiment has the traveling wave deflector 24, a deflection voltage having a short rise up time can be applied to the deflecting electrode. Accordingly, the amplitude of the deflecting voltage can be lowered, and thus the deflecting circuit 34 can be simplified in construction.

As described above, since the electron stream detector 26 of this embodiment includes the microchannel plate (MCP) 26B having an electron multiplying capability and the phosphor screen 26A, the photoelectrons incident to the electron stream detector 26 are multiplied by approximately 10 thousand times in the MCP 26B, and then impinge on the phosphor screen 26A with impinging electron energy of 3 to 5 KeV, thereby performing electron-to-light conversion. Generally, in a case where only the phosphor screen 26A is used, the photoelectrons may be converted into light with the impinging electron energy of 2 KeV. However, the photoelectrons having such a low impinging electron energy can not provide a streak image which has light intensity enough to be detected ( that is, the streak image comprises undetectable weak light). The MCP 26B serves to increase the light intensity of the streak image and compensate for such an weak light intensity.

Figure 2:
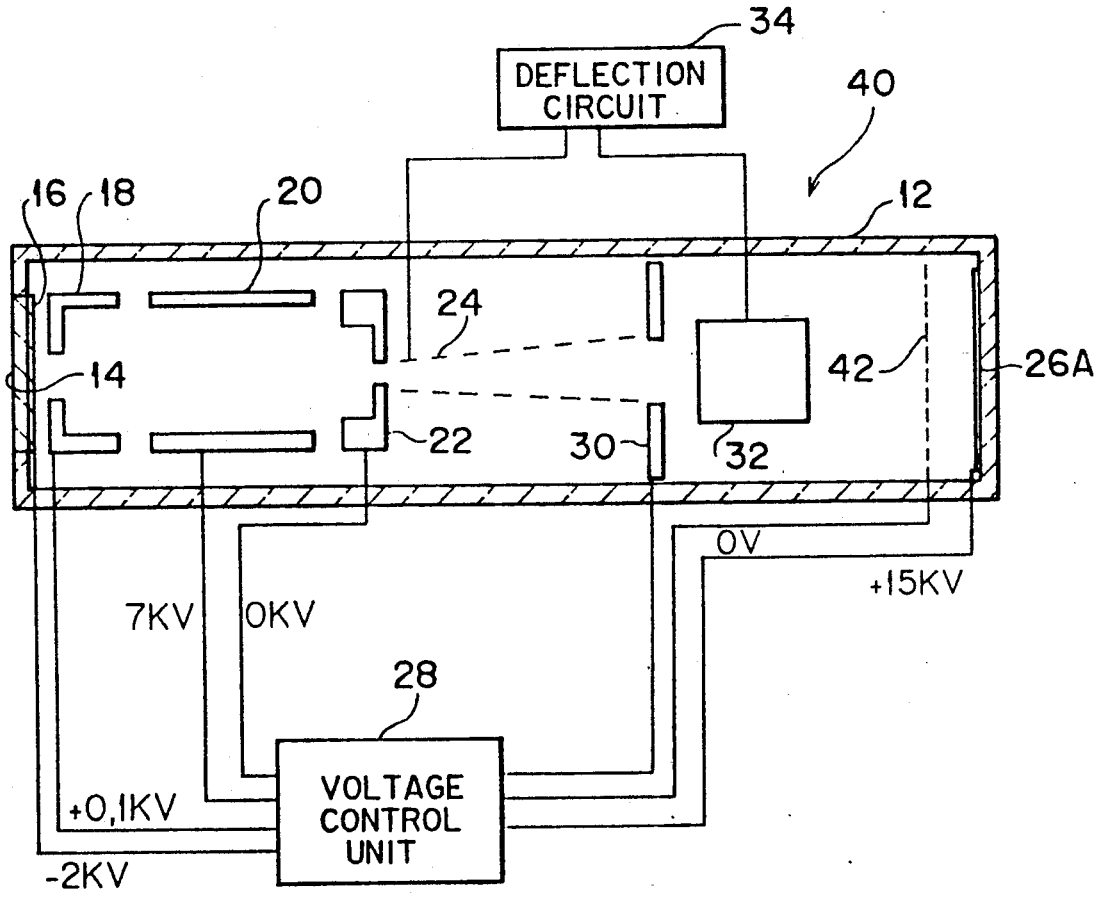
FIG. 2 shows a second embodiment of the streak camera according to this invention.

FIG. 2 shows a second embodiment of the streak camera according to this invention.

The streak camera of this embodiment has the substantially same construction as the first embodiment as shown in FIG. 1, except that the MCP 26B is replaced by an accelerating mesh electrode 42 serving as the rear-side accelerating means, and the accelerating mesh electrode 42 and the phosphor screen 26A arc supplied with 0 V and 15 KV, respectively, by the voltage control unit 28. The same elements as those of the first embodiment are represented by the same reference numerals, and the description thereof is eliminated.

In this embodiment, the rear-side accelerating mesh electrode 42 is supplied with the same voltage (0 V) as the anode 22 and the phosphor screen 26A is supplied with a positive voltage of 15 KV to accelerate the photoelectrons at the rear side of the streak tube and supply the photoelectrons with a sufficient impinging electron energy (that is, compensate for lack of the impinging electron energy of the photoelectrons due to a lower anode voltage). Like the first embodiment, the photoelectrons can be deflected with the deflection voltage having small amplitude, and a high time resolution can be obtained.

In the second embodiment, a gain is increased by supplying the phosphor screen 26A with a positive voltage (15 KV). However, even such positive voltage is still insufficient for forming a streak image having large intensity. In order to further increase the gain, the streak camera may be coupled to an image intensifier and then the intensified streak image may be read out by a TV unit. Further, the phosphor screen 26A may be replaced by a solid image pickup element such as a rear-surface bombarding type of CCD (charge-coupled device). In this case, not only high S/N ratio is obtained, but also an external image intensifying device is unnecessary because the CCD has an electron multiplying capability.

Figure 3:
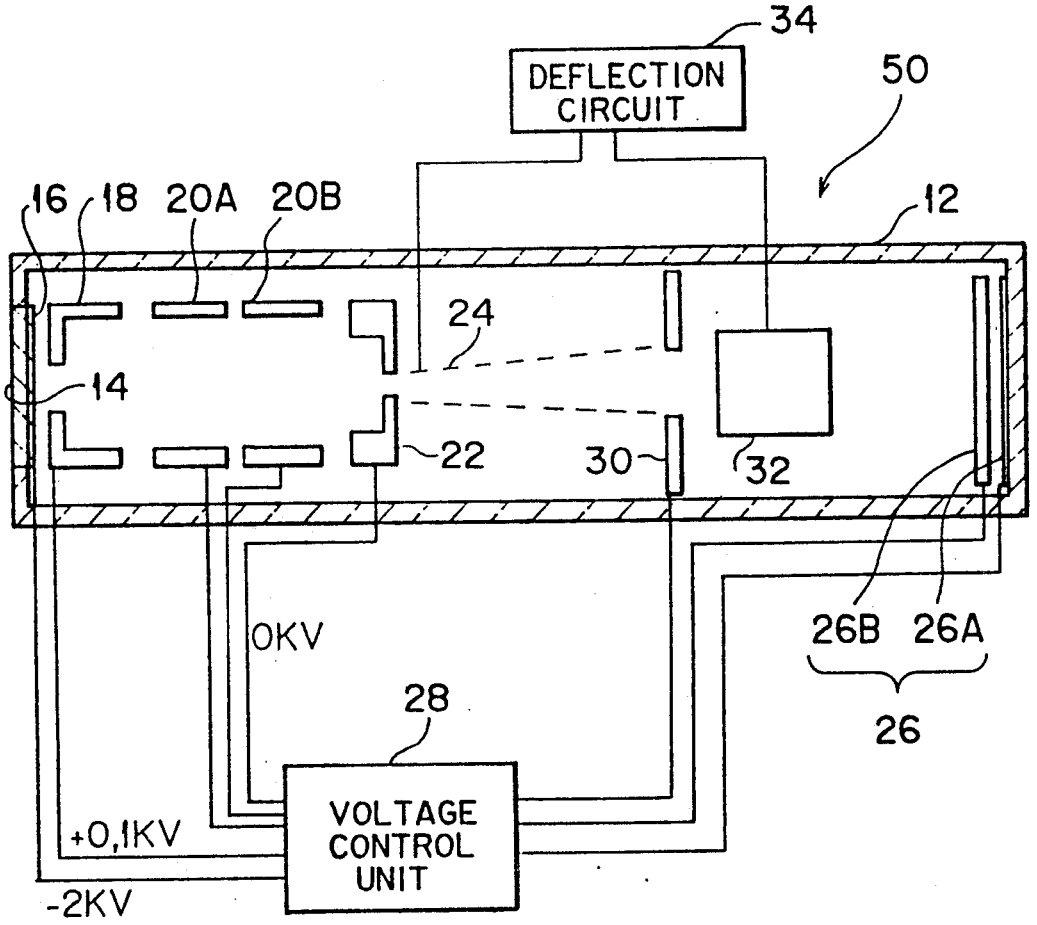
FIG. 3 shows a third embodiment of the streak camera according to this invention.

FIG. 3 shows a third embodiment of the streak camera according to this invention.

The streak camera as shown in FIG. 3 has the same construction as the first embodiment as shown in FIG. 1, except that the focusing electrode 20 comprises two segmented focusing electrodes 20A and 20B. The same elements as those of FIG. 1 are also represented by the same reference numerals.

In this embodiment, at least one of the two segmented focusing electrodes 20A and 20B are supplied with a higher positive potential than the acceleration electrode 20A and the anode 22, that is, at least one of the focusing electrodes 20A and 20B is kept at the highest positive potential in a photocathode-to-anode region by the voltage control unit 28. This potential arrangement can improve an electron lens effect of the electron lens system including the focusing electrode 20A and 20B, so that distortion in electric field of the electron lens system is reduced, and the time resolution and the spatial resolution of the streak camera is improved. Experimentally, in a case of a streak tube having an axial length of 300 mm, a voltage difference between the photocathode 16 and the anode 22 is preferably 2 KV, and the amplitude of a deflection voltage is preferably −10 V (−10 V).

Generally, the deflecting electrode of the traveling wave deflector 24 is terminated by a resistance Z (that is, has the resistance Z at one end thereof), and thus a deflection power P to be applied to the deflecting electrode is equal to $V^2/Z$ where V represents the amplitude of a deflection voltage. In this case, V=+10 V (−10 V), Z=100 ohms and thus P=1 W. The deflection circuit providing such a lower power (1 W) is simplified in construction. The amplitude of the deflection voltage to be applied to the deflecting electrode is enlarged in proportion of increase of a potential (voltage) to be applied to the anode 22. Accordingly, it is apparent from the above relationship between the power(P) and the amplitude(V) of the deflection voltage that as the potential of the anode 22 is heightened, the power (P) to be applied to the deflecting electrode is increased in proportion of second power of the increase of the potential (voltage) of the anode 22. Accordingly, the amplitude of the deflection voltage after increase of the potential of the anode 22 is higher than that before increase of the potential of the anode, and thus a larger power is required to perform a deflecting operation. Such a deflection circuit capable of providing a larger power is complicated in construction. Generally, a deflection power at which the deflection circuit can be simplified in construction is approximately 6 W at maximum. Therefore, an accelerating voltage (5 KV) to be applied to the photoelectrons, which is matched with the deflection power of 6 W, corresponds to the maximum voltage difference between the photocathode 16 and the anode 22. In other words, the voltage to be applied to the anode 22 should be a positive voltage below 5 KV with respect to the voltage to be applied to the photocathode 16. A positive voltage below 2 KV is preferably supplied to the anode 22 with respect to the voltage (for example, 0 KV) to be applied to the photocathode 16. Further, as described above, at least one electrode element of the focusing electrode 20 should be kept at the highest positive potential among the photocathode, the accelerating electrode, the focusing electrode and the anode.

Figure 4A:
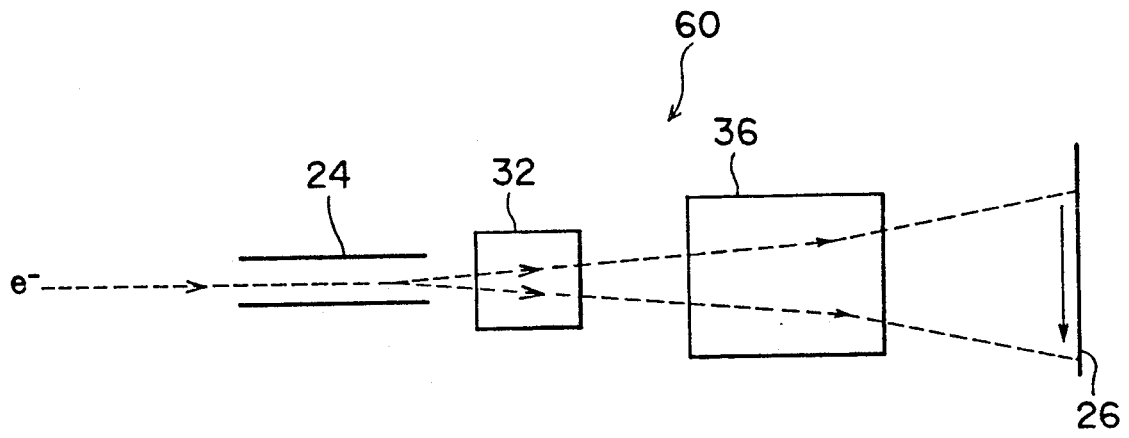
FIG. 4(A) shows a deflection enlarging electron lens provided between the traveling wave deflector and the electron stream detector.
Figure 4B:
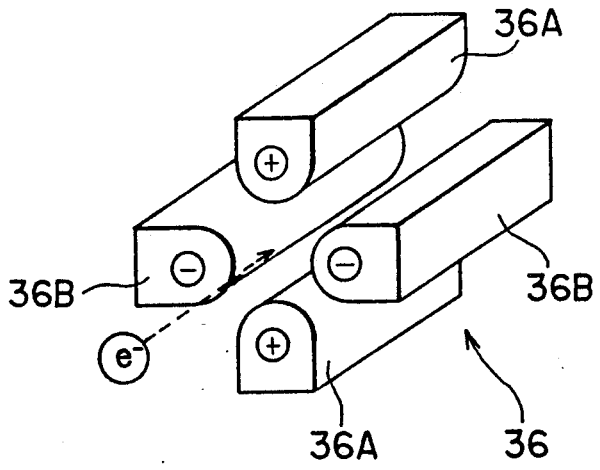
FIG. 4(B) shows a quadripole lens serving as the deflection enlarging electron lens.

Any modifications may be made to the first and second embodiments insofar as they do not depart from the subject matter of this invention. For example, in the first and second embodiments as described above, the accelerating electrode 18 is designed to have an aperture for transmitting the photoelectrons therethrough, however, may be designed to have a slit, or may be designed in a mesh form. Further, the shift deflecting electrode 32 of the first embodiment is designed in a plate form, however, may be a traveling wave deflector. Further, as shown in FIG. 4(A), a deflection enlarging electron lens 36 is further provided between the traveling wave deflector 32 and the electron stream detector 26 in order to improve the deflection sensitivity. The deflection enlarging electron lens 36 may be a quadripole lens comprising two confronted positive electrodes and two confronted negative electrodes which are arranged crosswise, as shown in FIG. 4(B).

According to the streak camera of this invention, a small voltage difference is provided between the photocathode and the anode which serves to determine the transit speed of the photoelectrons incident to the electron deflector with a potential difference between the photocathode and the anode, and the traveling wave deflector is used as the electron deflector so that a deflection voltage having short rise-up time and a small amplitude (several tens volts) can be used. As a result, a deflection circuit, which has been most complicated in construction and adjustment and expensive in cost in all elements of the streak camera, can be simplified i construction and adjustment and reduced in cost.

Further, by providing a microchannel plate or a rear-side accelerating electrode to the electron stream detector, even though photoelectrons has low impinging electron energy on the electron stream detector, these photoelectrons are multiplied or further accelerated, and then impinge on the electron stream detector with high impinging electron energy, so that the streak camera according to this invention can obtain a bright streak image.

In addition, a gap between the front-side acceleration electrode and the anode is kept at a high positive potential with respect to the photocathode, so that the time resolution and the spatial resolution can be improved.

What is claimed is

1. A streak camera for detecting a light signal representing optical events occurring in ultra-short time intervals, comprising:

a photocathode for emitting photoelectrons as an electron stream upon incidence of the light signal thereto;

a first accelerating electrode for accelerating the electron stream emitted from said photocathode;

a focusing electrode comprising at least one electrode element for focusing the accelerated electron stream;

an anode for electrostatically attracting the focused electron stream;

a traveling wave deflector having a deflecting electrode for deflecting the electron stream transmitted through said anode with a deflection voltage having a phase velocity;

a deflection circuit for controlling the deflection voltage to be applied to said deflecting electrode of said deflector 34;

an electron stream detector for detecting the electron stream deflected by said deflector; and a voltage control unit for controlling voltages to be applied to said photocathode, said accelerating electrode, said focusing electrode, said anode and said electron stream detector, thereby controlling a potential distribution in a photoelectron transit path, wherein said voltage control unit carrys out a voltage supply operation such that said anode is supplied with a positive voltage below 5 KV with respect to a voltage to be applied to said photocathode, and said electrode element of said focusing electrode is kept at the highest positive potential among said photocathode, said accelerating electrode, said focusing electrode and said anode.

2. A streak camera as claimed in claim 1, wherein said electron stream detector comprises a microchannel plate for multiplying the photoelectrons of the electron stream emitted from said photocathode and a phosphor screen for forming a streak image on the basis of the multiplied photoelectrons.

3. A streak camera as claimed in claim 1, wherein said electron stream detector comprises a second accelerating electrode for accelerating the electron stream, and a phosphor screen for forming a streak image on the basis of the accelerated electron stream.

4. A streak camera as claimed in claim 3, wherein said second accelerating electrode comprises a mesh electrode.

5. A streak camera as claimed in claim 1, wherein said deflection circuit supplys said deflecting electrode with a deflection voltage of several tens volts to thereby perform a deflection operation of the photoelectrons.

6. A streak camera as claimed in claim 1, further comprising a shift deflection electrode provided between said traveling wave deflector and said electron stream detector for perform a positional correction of the streak image on said phosphor screen and a blanking operation of the streak image, said shift deflection electrode being supplied with a shift voltage by said deflection circuit.

7. A streak camera as claimed in claim 6, further comprising an isolation electrode provided between said traveling wave deflector and said shift deflection electrode for preventing interference between the deflection voltage and the shift voltage.

8. A streak camera as claimed in claim 1, wherein the phase velocity of said traveling wave deflector is matched with a transit speed of the photoelectrons.

9. A streak camera as claimed in claim 1, further comprising a deflection enlarging electron lens provided between said traveling wave deflector and said electron stream detector to improve a deflection sensitivity of said streak camera.

10. A streak camera as claimed in claim 9, wherein said deflection enlarging electron lens comprises a quadripole lens.

11. A streak camera as claimed in claim 1, wherein said first accelerating electrode comprises an aperture type, a slit type or a mesh type.

* * * * *